United States Patent [19]

Santén et al.

[11] Patent Number: 4,710,269

[45] Date of Patent: Dec. 1, 1987

[54] RECOVERING CHEMICALS FROM SPENT PULP LIQUORS

[75] Inventors: Sven Santén, Hofors; Sven Eriksson; Ragnar Bernhard, both of Falun, all of Sweden

[73] Assignee: SKF Steel Engineering AB, Hofors, Sweden

[21] Appl. No.: 822,564

[22] Filed: Jan. 27, 1986

[30] Foreign Application Priority Data

Mar. 26, 1985 [SE] Sweden ..... 8501465

[51] Int. Cl.[4] ..... D21C 11/12

[52] U.S. Cl. ..... 162/30.1; 162/30.11; 423/207; 423/DIG. 3

[58] Field of Search ..... 162/30.1, 30.11; 423/207, DIG.3; 159/47.3

[56] References Cited

U.S. PATENT DOCUMENTS

| | | | |
|---|---|---|---|
| 3,666,619 | 5/1972 | Mailhos et al. | 162/30.11 |
| 3,674,630 | 7/1972 | Copeland | 162/30.11 |
| 4,011,129 | 3/1977 | Tomlinson, II | 162/30.11 |
| 4,135,968 | 1/1979 | Dehaas | 162/30.11 |
| 4,439,272 | 3/1984 | Nguyen | 162/30.11 |
| 4,601,786 | 7/1986 | Santen et al. | 162/30.11 |

FOREIGN PATENT DOCUMENTS

| | | | |
|---|---|---|---|
| 2506971 | 9/1976 | Fed. Rep. of Germany | 162/30.1 |

*Primary Examiner*—S. Leon Bashore
*Assistant Examiner*—K. M. Hastings
*Attorney, Agent, or Firm*—Armstrong, Nikaido, Marmelstein & Kubovcik

[57] ABSTRACT

The present invention relates to a method and means of increasing capacity and improving the chemical recovery process when using a conventional soda recovery boiler for recovering chemicals out of spent sulphate liquors. The spent sulphate liquor is supplied in full or in part to a liquor gasifier (8) while external energy independent of combustion is simultaneously supplied (at 16, 17). The temperature and oxygen potential are carefully controlled independently of each other by means of controlled supply of the energy. The product thus obtained is thereafter introduced in full or in part into a soda recovery boiler (1).

7 Claims, 1 Drawing Figure

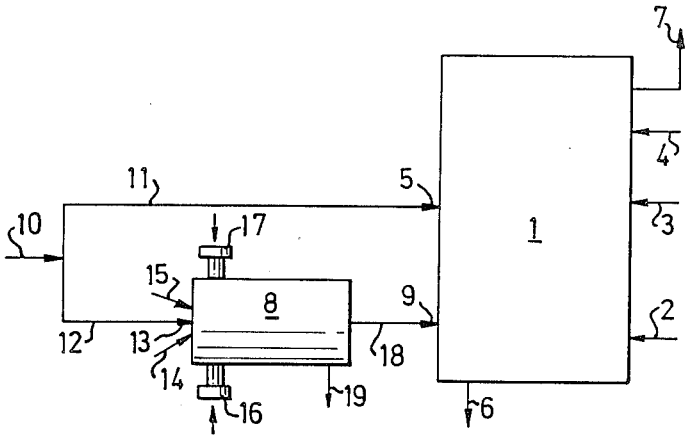
7
4
3
2
1
5
11
10
17
15
8
9
12
13
14
18
19
16
6

RECOVERING CHEMICALS FROM SPENT PULP LIQUORS

The present invention relates to a method of increasing capacity and improving the chemical recovery process when using a conventional soda recovery boiler.

Every effort is made in the pulp industry to re-utilize chemicals to the greatest possible extent, for both economic and environmental reasons. Recovery processes for this purpose consist essentially of three part-processes: a sulphur reducing process, a process for separating out inorganic products and an oxidation process for the organic substance, with generation of energy. These processes can be performed as separate part-processes or in a combined processing apparatus. Modern soda recovery boilers, known as Tomlinson boilers, are of the latter type.

The soda recovery boiler is generally the part of the total chemical-recovery cycle which limits the possibility of building out and/or increasing capacity for the other parts of the process. Limiting its capacity is the size of the gas volume which can pass through the primary air zone of the soda recovery boiler without drawing with it solid and liquid particles of liquor.

Another drawback of this process is that sulphate remains in the chemical melt and passes through the entire cycle as ballast. Furthermore, a relatively large part of the sodium content exists as carbonate which must be taken care of in a separate causticizing step.

Research in this field has long been intensive to find new technical solutions but hitherto the soda recovery boiler has proved superior, while at the same time calculations based on chemical and thermodynamic relations show that an ideal chemical recovery process is practically impossible due to chemical, thermodynamic and energy limitations.

The chemical recovery process is also intimately associated with energy recovery from spent pulp liquor, particularly since a large amount of steam is needed in the various process steps.

The main object of the invention is to achieve a method to increase the capacity of the soda recovery boiler and a means for performing the method according to the invention, said means supplementing the soda recovery boiler of today.

The above is substantially achieved with the method according to the invention in that the spent sulphate liquor is supplied in full or in part to a liquor vaporizer (i.e. a gasifier) when external energy independent of combustion is supplied simultaneously, whereupon the temperature and oxygen potential are carefully controlled independently of each other by means of controlled supply of said energy, and wherein the product thus obtained is thereafter introduced in full or in part into the soda recovery boiler from which inorganic constituents are withdrawn primarily in the form of a melt and the organic part is withdrawn in the form of a gas.

The external supply of energy to the liquor vaporizer(s) produces a high temperature with a low oxygen potential. A melt is thus obtained consisting primarily of NaOH and $Na_2S$, i.e. white liquor, while at the same time the formation of $Na_2CO_3$ is restrained, and a gas containing CO, $H_2$, $CO_2$, $H_2O$, Na and NaOH.

According to a preferred embodiment of the invention the external energy is supplied in the form of a gas rich in energy, which has been heated in a plasma generator.

According to another embodiment of the invention carbonaceous material and/or oxygen gas are injected into the liquor vaporizer, thus enabling the process to be further controlled.

According to a further embodiment of the invention a temperature of 1000°-1400° C. is maintained in the liquor gasifier, $Na_2CO_3$ then existing in dissociated form. A part of the original quantity of $Na_2CO_3$ will be re-formed due to the temperature drop upon entry into the recovery boiler. However, a considerable reduction of the $Na_2CO_3$ in the melt from the subsequent recovery boiler is achieved.

The quantity of thick liquor which can be passed through the gasifier before entering the recovery boiler depends on the particular installation in which the invention is to be utilized. The volume of gas through the primary air zone of the recovery boiler decreases in direct proportion to the quantity of thick liquor passing through the liquor gasifier and the capacity can therefore be considerably increased.

According to yet another embodiment of the invention the chemical melt obtained in the liquor gasifier is withdrawn before the products formed therein are introduced into the soda recovery boiler. The great advantage is thus obtained in that the melt, containing primarily $Na_2S$ and a small quantity of NaOH, can be used directly in the digestion process.

According to a further embodiment of the invention the chemical melt obtained in the liquor gasifier is introduced into the soda recovery boiler and mixed with the rest of the chemical melt there. The melt thus obtained is of higher quality than that obtained conventionally since the sulphate content is greatly reduced, to the advantage of the sulphide content, as well as the carbonate content being decreased.

Burning less liquor in the primary air zone of the recovery boiler gives a more reducing atmosphere, which also promotes the recovery process, producing greater quantities of sulphide instead of sulphate and hydroxide instead of carbonate.

The means for performing the process according to the invention comprises a conventional soda recovery boiler with primary, secondary and tertiary air-supply tuyeres and steam tubes at the top for the recovery of energy, and is characterised by at least one liquor vaporizer to replace at least one primary air-supply tuyere, members for injecting liquor, members for the supply of external energy independent of combustion and a channel communicating with said soda recovery boiler.

According to a preferred embodiment of the means according to the invention at least one plasma generator is used as source for the supply of external energy independent of combustion.

According to another embodiment of the means according to the invention the liquor gasifier may be provided with tuyeres for the injection of carbon carriers and/or oxygen-containing gas.

According to yet another embodiment of the means according to the invention the liquor gasifier is provided with an outlet for chemical melt.

Other features and advantages of the present invention will be revealed in the following detailed description with reference to two embodiments illustrating the invention and to the accompanying drawing in which the FIGURE shows schematically one embodiment of a means for performing a process according to the invention.

In a soda recovery boiler, designated 1 in the FIGURE, air is generally supplied at three different levels, primary air at 2, secondary air at 3 and tertiary air at 4. Spent liquor in the form of thick liquor is introduced in atomized form at 5. Inorganic constituents are withdrawn in the form of a melt from a bottom outlet 6 while organic material is withdrawn in the form of a gas which is burned in the upper portion of the recovery boiler and then passes through an outlet 7. The energy in the gas is recovered in the form of superheated steam.

Air is supplied to the recovery boiler through a number of tuyeres arranged around the periphery of the boiler and according to the invention a gas mixture from the liquor gasifier 8 replaces the air in some of the primary air tuyeres at 9.

Thick liquor from a sulphate cellulose plant is supplied to the chemical recovery plant through conduit 10, some being fed directly to the recovery boiler through conduit 11 and some to the liquor gasifier 8 through conduit 12. The liquor gasifier comprises a reaction chamber into which lances, symbolized by the arrow 13 are directed, and lances 14, 15 for the supply of carbon and/or oxygen carriers in atomized form to the reaction chamber. Plasma generators 16, 17 are also arranged to supply external energy with the aid of an electrically heated gas. The supply lances are preferably arranged immediately in front of the opening of each plasma generator.

The gas mixture generated in the liquor vaporizer is supplied to the boiler through conduit 18 via inlet 9.

The chemical melt obtained in the liquor vaporizer may be withdrawn through an outlet 19 or introduced into the recovery boiler. This allows a melt consisting primarily of $Na_2S$ to be withdrawn for direct re-use in the digestion process.

As mentioned earlier, a temperature of 1000°–1400° C. is preferably maintained in the vaporizer with the aid of energy-rich gas heated in the plasma generator(s). This enables the temperature and the oxygen potential to be extremely carefully regulated. The water content in the thick liquor and oxygen bound in the dry substance are primary sources of oxidant. As mentioned previously, the supply of carbon and/or oxygen carriers can also be utilized as means of control.

The use of plasma generators for the supply of external energy enables total gasification of the organic fraction of the spent liquor. A certain quantity of the sodium carbonate present in dissociated form will be partially reformed upon entry into the recovery boiler but the quantity of sodium carbonate will be considerably lower than in a conventional process which only partially combusts the liquor.

The following examples further illustrate the invention. However, the invention is not limited to these examples.

EXAMPLE 1

A thick liquor having a dry substance content (DS) of 67% was supplied to a conventional recovery boiler. Combustion to 65% occurred in the primary zone which is a condition for total conversion of the liquor.

The following was obtained, calculated per 1 ton DS.

| Melt | kmol | kg |
|---|---|---|
| $Na_2CO_3$ | 2.473 | 262.035 |
| $Na_2S$ | 1.329 | 103.715 |
| $Na_2SO_4$ | 0.231 | 27.500 |
| NaOH | 0.230 | 9.198 |
| **Gas** | **kmol** | **$m^3$ N** |
| $CO_2 + H_2O$ | 53.604 | 1200.730 |
| $CO + H_2$ | 20.333 | 455.459 |
| $N_2$ | 134.723 | 3017.787 |

A total of 4673.976 $m^3N$ gas was thus obtained, corresponding to 18 370.608 $m^3$ gas at 800° C., the temperature normally prevailing in a recovery boiler.

EXAMPLE 2

A spent liquor with a dry substance content of 67% was injected into the liquor vaporizer. The DS composition was as follows:

| | |
|---|---|
| C | 35% |
| H | 4% |
| Na | 19% |
| S | 5% |
| O | 37% |

2100 kwh/ton DS was supplied and the temperature in the gasifier was maintained at 1300° C.

The following was obtained per ton DS:

| Melt | kmol | kg |
|---|---|---|
| $Na_2S$ | 1.538 | 120 |
| NaOH | 0.250 | 10 |
| $Na_2CO_3$ | 0.189 | 20 |

This melt may be withdrawn separately or may be included in the chemical melt from the recovery boiler.

| Gas | kmol | $m^3$ N |
|---|---|---|
| NaOH | 1.330 | 29.792 |
| Na | 3.231 | 72.374 |
| CO | 24.117 | 540.221 |
| $CO_2$ | 5.045 | 113.008 |
| $H_2O$ | 16.281 | 364.694 |
| $H_2$ | 31.082 | 696.237 |
| $H_2S$ | 0.022 | 0.493 |

The temperature was reduced to 800° C. in the recovery boiler, causing gaseous Na and NaOH to be converted to liquid form and a certain quantity of carbonate being produced.

Assuming that about 50% of the Na content is converted to carbonate, the following balance is obtained:

| Melt from the gas | kmol | kg |
|---|---|---|
| $Na_2CO_3$ | 2.281 | 189.300 |
| NaOH | 2.281 | 91.217 |

| Gas from the vaporizer after the primary air zone | kmol | $m^3$ N |
|---|---|---|
| CO | 19.790 | 443.296 |
| $CO_2$ | 7.091 | 158.838 |

-continued

| Gas from the vaporizer after the primary air zone | | |
|---|---|---|
| | kmol | $m^3$ N |
| $H_2O$ | 8.772 | 195.373 |
| $H_2$ | 38.166 | 854.907 |
| $H_2S$ | 0.022 | 0.493 |

A total of 1 652.907 $m^3N$ gas was thus obtained from the gasifier after the primary air zone, corresponding to 6 496.591 $m^3$ gas at 800° C.

Assuming then that the single limiting factor in soda recovery boilers of today is the quantity of gas which can be allowed to pass through the primary zone, a capacity increase of 47.7% is achieved when half the liquor is gasified in the vaporizer according to the invention before entering the recovery boiler and the remaining liquor is combusted in conventional manner.

The product obtained from this process has the following composition:

| | kg/ton DS |
|---|---|
| $Na_2CO_3$ | 235.668 |
| NaOH | 55.208 |
| $Na_2S$ | 111.858 |
| $Na_2SO_4$ | 13.500 |

The quality of the product is further improved if chemical melt is removed from the liquor gasifier.

We claim:

1. A method of increasing the capacity and improving the chemical recovery of a soda recovery boiler, comprising the steps of:

supplying spent sulphate liquor to a liquor gasifier;

supplying external energy in the form of a gas rich in energy which has been heated in a plasma generator, independent of combustion to the liquor gasifier, controlling separately the temperature and oxygen potential of the liquor gasifier;

producing a chemical melt product comprising a sodium compound in the liquor gasifier;

producing a gas product comprising Na, Co and $H_2$ in the liquor gasifier;

introducing the gas product of the liquor gasifier into a soda recovery boiler; and withdrawing from the soda recovery boiler the organic constituents of the liquor gasifier gas product primarily as a gas.

2. A method according to claim 1, wherein carbon carriers and/or oxygen carriers are injected into the liquor gasifier.

3. A method according to claim 1, wherein a temperature of 1000°-1400° C. is maintained in the liquor gasifier.

4. A method according to claim 1, wherein the chemical melt obtained in the liquor gasifier is withdrawn to a receptacle other than the soda recovery boiler before the gas formed therein is introduced into the soda recovery boiler.

5. A method according to claim 1, wherein the chemical melt obtained in the liquor gasifier is introduced into the soda recovery boiler.

6. The method of claim 1, wherein at least part of the chemical melt product of the liquor gasifier is transmitted to the soda recovery boiler.

7. The method of claim 4, wherein the chemical melt is withdrawn for re-use in a digestion process.

* * * * *